US009074389B2

(12) United States Patent
Shimizu

(10) Patent No.: US 9,074,389 B2
(45) Date of Patent: Jul. 7, 2015

(54) LOCK APPARATUS FOR OPENING/CLOSING MEMBER

(75) Inventor: Toshihiro Shimizu, Yokohama (JP)

(73) Assignee: PIOLAX, INC, Yokohama-Shi, Kanagawa (JP)

( * ) Notice: Subject to any disclaimer, the term of this patent is extended or adjusted under 35 U.S.C. 154(b) by 0 days.

(21) Appl. No.: 14/234,618

(22) PCT Filed: Jul. 5, 2012

(86) PCT No.: PCT/JP2012/067167

§ 371 (c)(1),
(2), (4) Date: Jan. 23, 2014

(87) PCT Pub. No.: WO2013/018496

PCT Pub. Date: Feb. 7, 2013

(65) Prior Publication Data

US 2014/0150505 A1 Jun. 5, 2014

(30) Foreign Application Priority Data

Aug. 2, 2011 (JP) ..... 2011-169593

(51) Int. Cl.
*E05B 15/00* (2006.01)
*E05B 13/10* (2006.01)
(Continued)

(52) U.S. Cl.
CPC . *E05B 15/00* (2013.01); *E05D 1/04* (2013.01); *E05B 83/30* (2013.01); *E05B 85/14* (2013.01); *E05C 9/043* (2013.01); *E05B 13/10* (2013.01); *E05B 9/04* (2013.01)

(58) Field of Classification Search
CPC ..... E05B 15/00; E05B 9/04; E05B 83/30; E05B 83/00; E05B 83/28; E05B 13/10; E05C 9/043; Y10T 16/53615; Y10T 16/5362; Y10T 16/53625; Y10T 16/5406; Y10T 16/544; Y10T 16/5445; Y10T 16/5448; Y10T 16/458; E05D 2001/045
USPC ..... 292/32, 33, 34, 37, 38, 40, 42, 137, 292/140, 143; 70/208, 210, 215, 224, 467
See application file for complete search history.

(56) References Cited

U.S. PATENT DOCUMENTS 814,354 A * 3/1906 Carter ..... 16/348
3,020,075 A * 2/1962 Johnstone et al. ..... 292/336.3
(Continued)

FOREIGN PATENT DOCUMENTS

CN 1944930 A 4/2007
CN 101103162 A 1/2008
(Continued)

OTHER PUBLICATIONS

International Search Report dated Aug. 7, 2012 in PCT/JP2012/067167.
(Continued)

*Primary Examiner* — Christopher Boswell
*Assistant Examiner* — Amanda L Miller
(74) *Attorney, Agent, or Firm* — McGinn IP Law Group, PLLC

(57) ABSTRACT

A lock apparatus includes a housing, a rotor having a bearing portion, rods, a return spring, and a knob having a holding portion and a presser element. The presser element is formed so as to overlap the bearing portion with a predetermined overlap width. When the rods are kept engaged with the engagement portions, a rotating center of the knob is positioned closer to the holding portion than a contact point between the bearing portion and the presser element.

15 Claims, 12 Drawing Sheets

(51) Int. Cl.

| | |
|---|---|
| ***E05D 1/04*** | (2006.01) |
| ***E05B 83/30*** | (2014.01) |
| ***E05B 85/14*** | (2014.01) |
| ***E05C 9/04*** | (2006.01) |
| ***E05B 9/04*** | (2006.01) |

(56) References Cited

U.S. PATENT DOCUMENTS

| | | | | |
|---|---|---|---|---|
| 5,061,023 | A * | 10/1991 | Soubliere et al. | 312/223.4 |
| 5,107,401 | A * | 4/1992 | Youn | 361/679.44 |
| 5,116,099 | A * | 5/1992 | Kwasnik et al. | 297/188.15 |
| 5,465,557 | A * | 11/1995 | Harte | 53/510 |
| 6,047,444 | A * | 4/2000 | Braun | 16/324 |
| 7,048,311 | B2 * | 5/2006 | Sawatani et al. | 292/33 |
| 7,455,333 | B2 * | 11/2008 | Ookawara | 292/34 |
| 2004/0017088 | A1 | 1/2004 | Sawatani et al. | |
| 2004/0051333 | A1 * | 3/2004 | Brown et al. | 296/37.12 |
| 2004/0168487 | A1 | 9/2004 | Sawatani et al. | |
| 2005/0006906 | A1 * | 1/2005 | Yamada et al. | 292/63 |
| 2006/0005589 | A1 * | 1/2006 | Hanjono et al. | 70/208 |
| 2007/0163310 | A1 * | 7/2007 | Ookawara et al. | 70/208 |
| 2009/0206625 | A1 * | 8/2009 | Toppani et al. | 296/37.12 |
| 2011/0174027 | A1 | 7/2011 | Ookawara et al. | |

FOREIGN PATENT DOCUMENTS

| | | | |
|---|---|---|---|
| JP | 6-42705 | | 6/1994 |
| JP | 2004-3227 | A | 1/2004 |
| JP | 2004-210260 | A | 7/2004 |
| JP | 2007-100343 | A | 4/2007 |
| WO | WO 0061901 | A1 * | 10/2000 |
| WO | WO 2010/038716 | A1 | 4/2010 |

OTHER PUBLICATIONS

Chinese Office Action dated Mar. 3, 2015 with an English translation thereof.

* cited by examiner

LOCK APPARATUS FOR OPENING/CLOSING MEMBER

TECHNICAL FIELD

The present invention relates to an opening/closing member lock apparatus for closing in a locked state an opening/closing member such as a lid which is installed in an opening portion in an instrument panel or the like of a motor vehicle, for example, so as to be opened and closed.

BACKGROUND ART

For example, a glove box is provided in an instrument panel or the like of a motor vehicle, and a lid is installed in an opening portion in the glove box so as to be opened and closed. A lock apparatus is provided to lock the lid to be closed with respect to the opening portion of the glove box, and to unlock the lid to be opened.

For example, Patent Literature 1 describes a side lock apparatus including a retainer which is fixed to a rear side of a lid, a rotor which is supported rotatably on a rear surface of the retainer, a pair of rods which are coupled to point to symmetric positions of the rotor so that distal end portions thereof can appear from and disappear into both sides of the lid, a knob which is attached to a front side of the retainer so as to cause the rotor to rotate by being pushed/pulled, and a return spring which normally rotationally biases the rods in directions in which the rods project from both of the sides of the lid. When the knob is pushed/pulled, the rotor rotates against the return spring so that the rods are pulled inwardly of the lid.

Referring to FIG. 12 together, in such knob 1, a pair of support pieces 2 project from both sides of a distal end portion thereof. Each support piece 2 has a shaft hole. Pivot shafts project from both sides of the retainer, and these pivot shafts are inserted into the shaft holes 2*a*, respectively. Thus, the knob 1 is attached to the retainer so as to be rotatable about a rotating center C1. A presser element 3 is provided at a distal end portion of the knob 1 and at an inner side of one of the support pieces 2 so as to be aligned with the shaft hole 2*a* of the same support piece 2. Namely, when the knob 1 is viewed from a side, the presser element 3 and the shaft hole 2*a* are provided nearly on the same line. On the other hand, a bearing portion 5 projects from the rotor 4, and the presser element 3 is overlapped on this with a predetermined overlap width L. When the knob 1 is pulled as indicated by an imaginary line in FIG. 12, the presser element 3 presses on the bearing portion 5 of the rotor 4, and the rotor 4 rotates about a rotating center C2 against a biasing force of the return spring.

PRIOR ART LITERATURE

Patent Literature

Patent Literature 1
JP-2007-100343-A

SUMMARY OF THE INVENTION

Problem that the Invention is to Solve

In the side lock apparatus of Patent Literature 1, since the presser element 3 and the shaft hole 2*a* are provided nearly on the same line, when the knob 1 is rotated and the presser element 3 presses on the bearing portion 5, while the rotor 4 rotates, the overlap width L of the presser element 3 with respect to the bearing portion 5 gradually reduces. As this occurs, the presser element 3 might be dislocated from the bearing portion 5, whereby the rotor 4 cannot be rotated any more.

To solve this problem, the length of one of the presser element 3 and the bearing portion 5 may be increased so as to ensure a larger overlap width L between the presser element 3 and the bearing portion 5. However, as this occurs, the knob 1 and the rotor 4 may become thick, and thus, the whole lock apparatus may also become thick.

An object of the invention is to provide an opening/closing member lock apparatus which can not only prevent a reduction in overlap width between a presser element and a bearing portion when a knob rotates but also realize a reduction in overall thickness of the apparatus.

Means for Solving the Problem

With a view to achieving the object, according to the invention, there is provided a lock apparatus for an opening/closing member which is installed in an opening portion in an installation base member so as to be opened and closed, including:

a housing which is attached to one of the installation base member and the opening/closing member;

a rotor which is attached rotatably to the housing;

a rod which is attached to the rotor so as to slide in an interlocked fashion with the rotor and so as to be engaged with or disengaged from an engagement portion provided on the other one of the installation base member and the opening/closing member;

a bearing portion which is provided on the rotor;

a return spring which rotationally biases the rotor directly or via the rod so that the rod is engaged with the engagement portion;

a knob which is attached rotatably to the housing and which has a holding portion at one end thereof; and a presser element which is formed at the other end of the knob so as to overlap the bearing portion with a predetermined overlap width and which presses on the bearing portion upon pulling of the knob so as to rotate the rotor against a biasing force of the return spring to thereby pull the rod out of the engagement portion, wherein, with the rod kept engaged with the engagement portion, a rotating center of the knob is positioned closer to the holding portion of the knob than a contact point between the bearing portion and the presser element.

There may also be provided the lock apparatus, wherein, upon pulling of the knob, the knob stops rotating and the rod is pulled out of the engagement portion within such a rotating range that the overlap width of the presser element with respect to the bearing portion does not become smaller than an overlap width in an initial state where the rod engages with the engagement portion.

There may also be provided the lock apparatus, wherein, upon pulling of the knob, the knob stops rotating and the rod is pulled out of the engagement portion within such a rotating range that the contact point between the bearing portion and the presser element does not go beyond a line which passes through the rotating center of the knob and which is parallel to a rotational shaft of the rotor.

There may also be provided the lock apparatus, wherein an arc-shaped groove is formed in the knob, wherein an arc-shaped projection or plural pin-shaped projections are formed on the housing so as to be inserted into the arc-shaped groove, and wherein the knob rotates about a center of an arc of the arc-shaped groove as a rotating center while being guided by the projection or projections which are inserted into the arc-shaped groove.

There may also be provided the lock apparatus, wherein a key cylinder is mounted rotatably in the knob, wherein a projection projects from a distal end of the key cylinder while being offset from a rotating center of the key cylinder, wherein, when the key cylinder is in a predetermined rotational position, the projection engages with a lock portion of the housing so as to restrict pulling of the knob, and wherein the lock portion of the housing is disposed adjacent to the rotor.

Advantage of the Invention

According to the invention, when the opening portion in the installation base member is closed with the opening/closing member, the rotor is rotationally biased by the return spring, and the rod engages with the engagement portion while being interlocked with the rotational motion of the rotor. Therefore, the opening/closing member can be locked in such a state that the opening/closing member closes the opening portion. On the other hand, when the knob is pulled in this locked state, the bearing portion of the rotor is pressed on by the presser element of the knob, whereby the rotor rotates against the biasing force of the return spring, and the rod is pulled out of the engagement portion. Therefore, the lock of the opening/closing member is cancelled, whereby the opening portion in the installation base member can be opened.

With the rod kept engaged with the engagement portion, the rotating center of the knob is positioned closer to the holding portion of the knob than the contact point between the bearing portion and the presser element. Therefore, upon pulling of the knob, the overlap width between the bearing portion of the rotor and the presser element of the knob can be increased gradually. As a result, the lock apparatus can be made thin and compact in size while preventing the dislocation of the presser element from the bearing portion by ensuring the overlap width between the bearing portion of the rotor and the presser element of the knob.

BRIEF DESCRIPTION OF THE DRAWINGS

FIG. 3A shows a perspective view of the housing, and FIG. 3B shows a perspective view seen differently from FIG. 3A.

FIG. 4A shows a perspective of the rotor, and FIG. 4B shows a perspective view seen differently from FIG. 4A.

FIG. 5A shows a perspective view of the knob, and FIG. 5B shows a perspective view seen differently from FIG. 5A.

FIG. 6A shows a perspective view of the lock apparatus, and FIG. 6B shows a perspective view seen differently from FIG. 6A.

FIG. 7A shows a rear view of the lock apparatus, and FIG. 7B shows a plan view thereof.

FIG. 11 is an explanatory diagram of the lock apparatus illustrating a rotating locus of a presser element, an overlap width between a bearing portion and the presser element and the like.

MODE FOR CARRYING OUT THE INVENTION

An embodiment of an opening/closing member lock apparatus according to the invention will be described.

Figure 9:
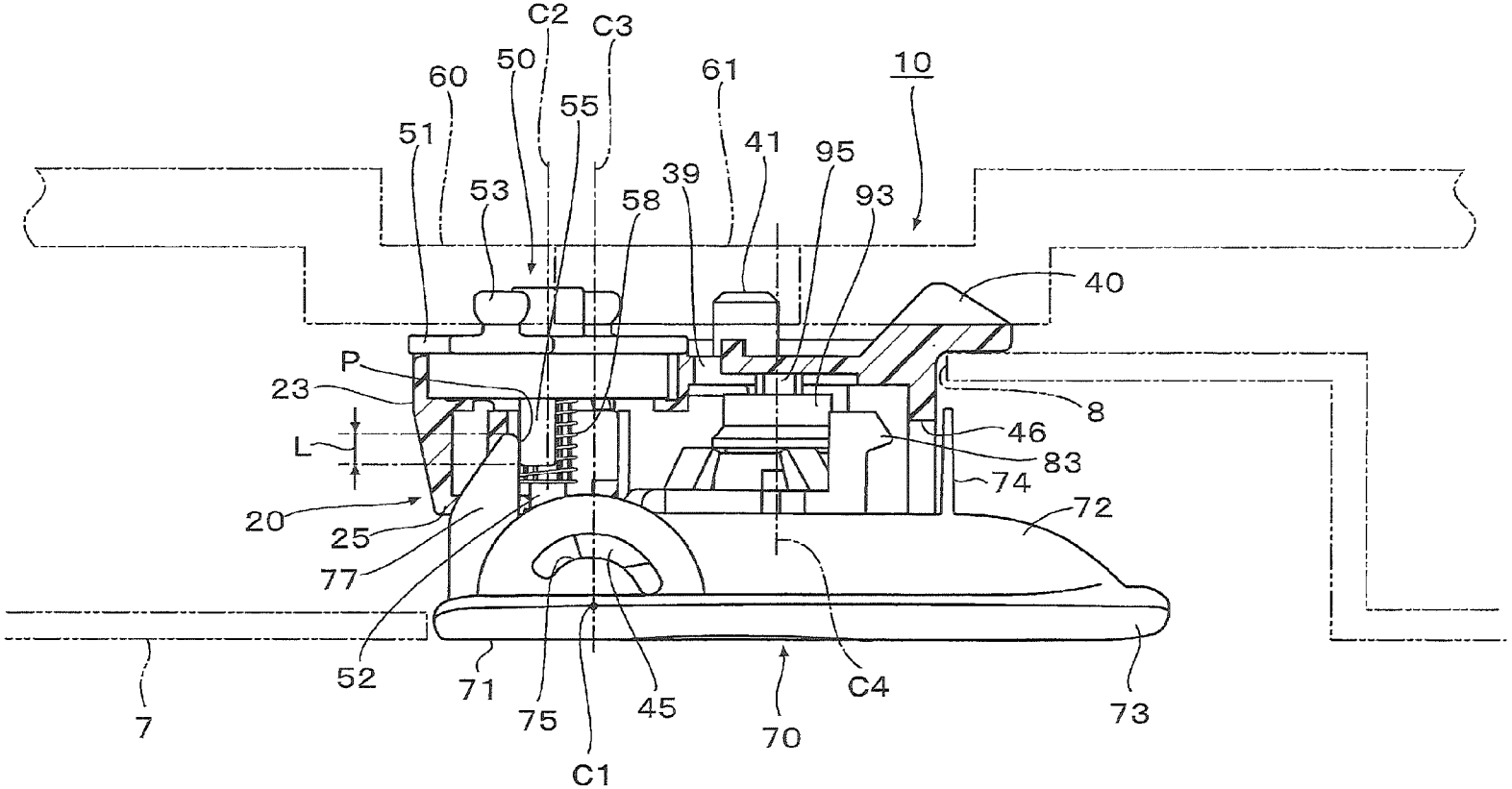
FIG. 9 is an explanatory diagram of the lock apparatus showing an initial state before the knob is pulled.
Figure 10:
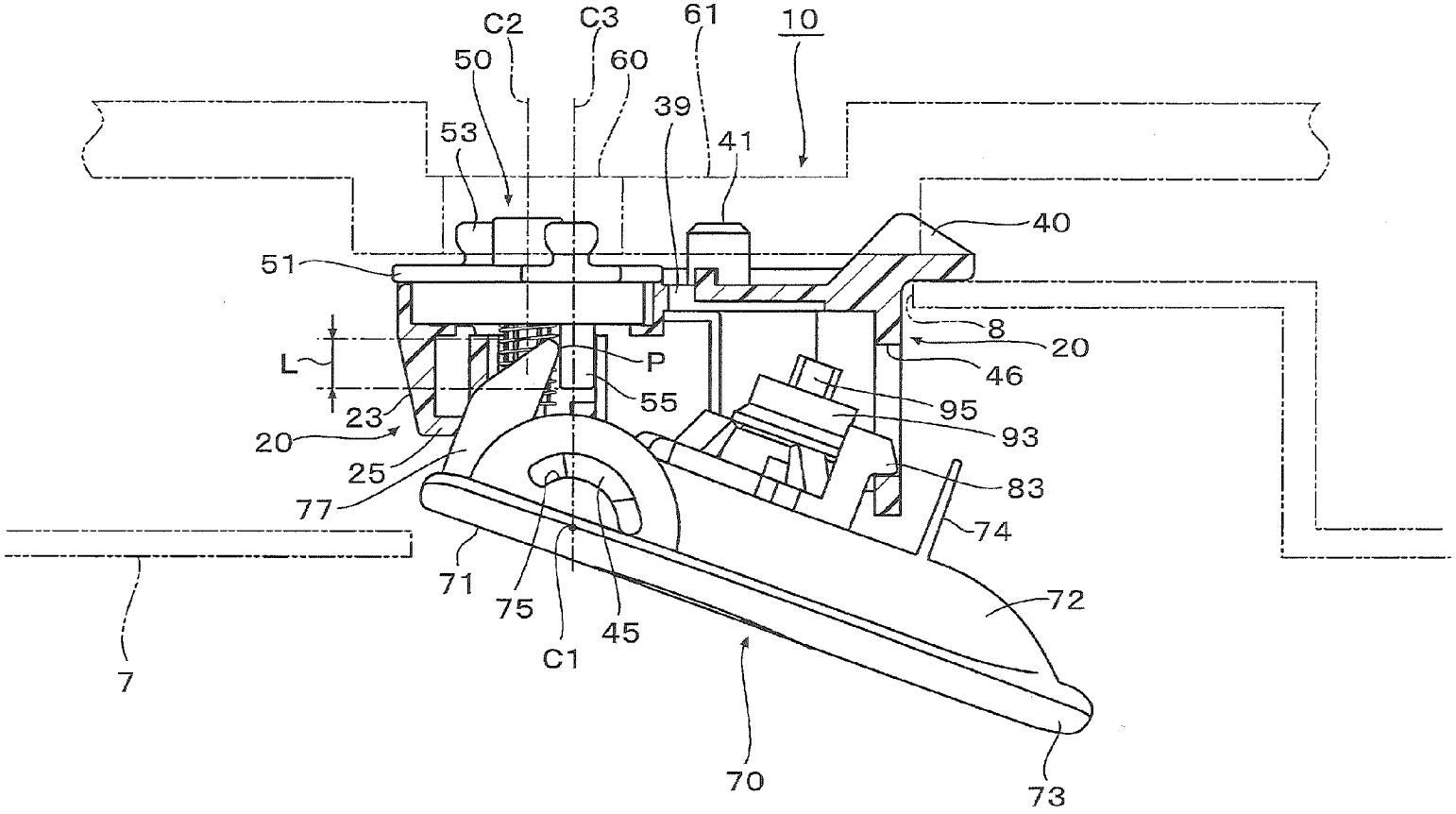
FIG. 10 is an explanatory diagram of the lock apparatus showing a state where the knob is pulled.

As shown in FIGS. 9 and 10, an opening/closing member lock apparatus (lock apparatus) 10 of this embodiment is adapted to lock a lid (opening/closing member) 7 which is installed in a non-shown opening portion in a glove box (installation base member) provided in an instrument panel of a vehicle, so as to inhibit an opening/closing movement of the lid 7.

Figure 1:
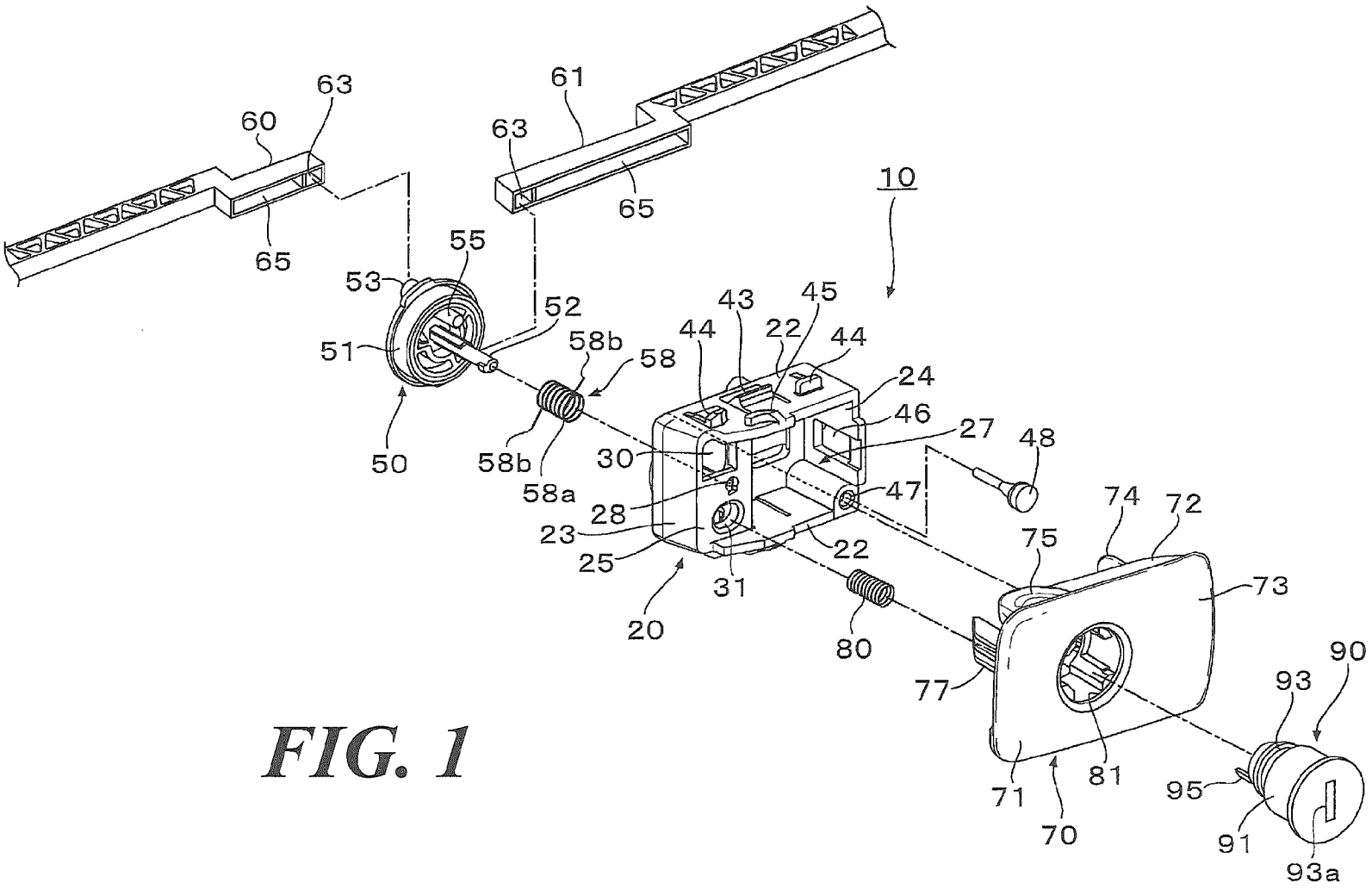
FIG. 1 is an exploded perspective view showing an embodiment of an opening/closing member lock apparatus according to the invention.
Figure 2:
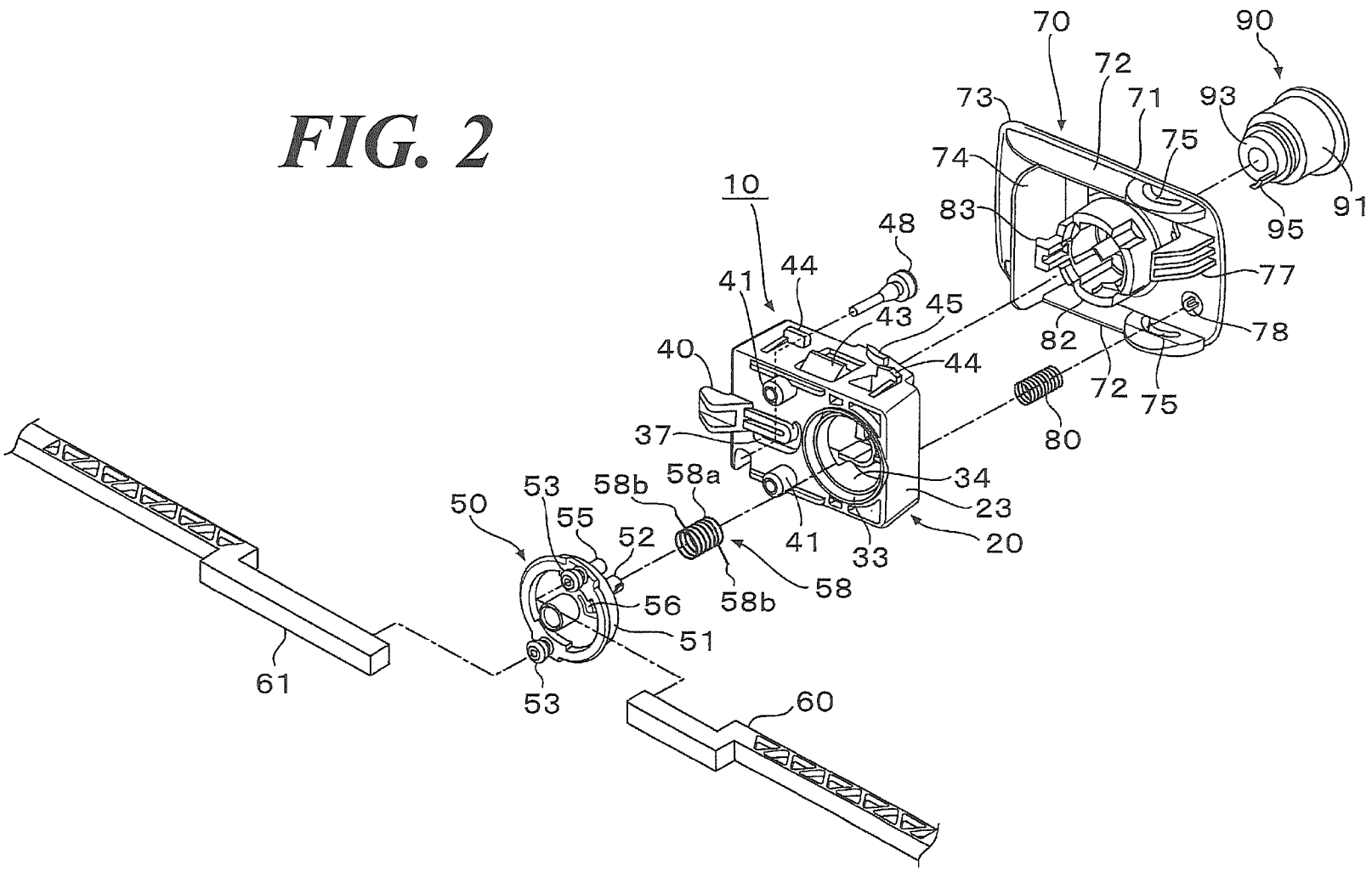
FIG. 2 is an exploded perspective view of the lock apparatus when viewed from a different direction from the direction in FIG. 1.

As shown in FIGS. 1 and 2, this lock apparatus 10 includes a housing 20, a rotor 50, a pair of left and right rods 60, 61, a bearing portion 55, a return spring 58, a knob 70, a presser element 77, a knob biasing spring 80 and a key cylinder 90. The housing 20 is installed in an installation hole 8 (refer to FIGS. 9, 10) in the lid 7. The rotor 50 is attached rotatably to the housing 20. The pair of left and right rods 60, 61 are attached to the rotor 50 so as to be engaged with or disengaged from non-shown engagement holes (engagement portion) which are provided in the opening portion in the glove box. The bearing portion 55 is provided on the rotor 50. The return spring 58 rotationally biases the rotor 50 directly or via the pair of rods 60, 61 so that the rods 60, 61 are engaged with the engagement holes. The knob 70 is attached rotatably to the housing 20, and has a holding portion 73 at one end thereof. The presser element 77 is formed at the other end of the knob 70 so as to overlap the bearing portion 55 with a predetermined overlap width L (refer to FIGS. 9, 10), and presses on the bearing portion 55 upon pulling of the holding portion 73 of the knob 70 so as to rotate the rotor 50 against a biasing force of the return spring 58 to thereby pull the rods 60, 61 out of the engagement holes. The knob biasing spring 80 is interposed between the other end portion of the knob 70 and the housing 20 so as to bias the knob 70 to move away from the housing 20. The key cylinder 90 is attached rotatably to the knob 70, and has a projection 95 to thereby lock the knob 70 with respect to the housing 20 so as to rotate or not to rotate.

Figure 3A:
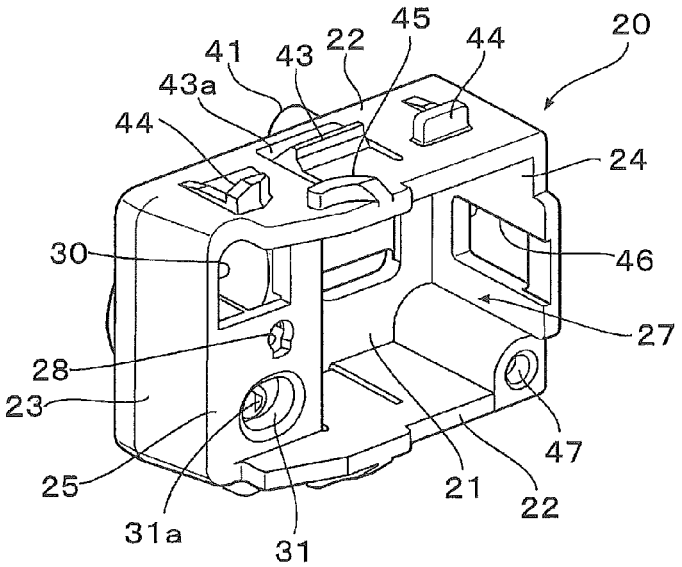
FIGS. 3A and 3B show a housing which makes up the lock apparatus.
Figure 3B:
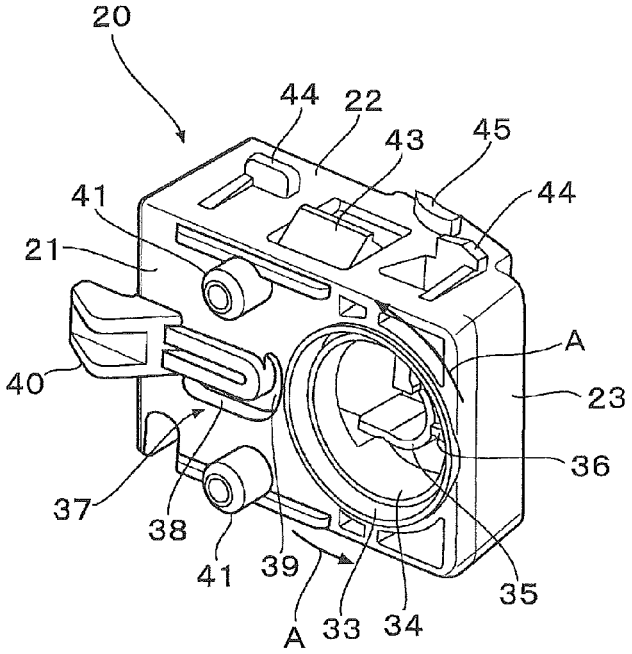

Referring to FIGS. 3A and 3B together, the housing 20 has a rectangular parallelepiped box shape which is elongated in a predetermined direction. The housing 20 has a bottom portion 21, side walls 22, 22, side walls 23, 24 and a rotor attachment wall 25. The bottom portion 21 is made horizontally long. The side walls 22, 22 are erected from long sides of the bottom portion 21. The side walls 23, 24 are erected from short sides of the bottom portion 21. The rotor attachment wall 25 is connected to the side wall 23 and parts of side portions of the side walls 22, 22. A space portion which is surrounded by the side walls 22, 22 and the side wall 24 and which lies adjacent to the rotor attachment wall 25 makes up a cylinder accommodation space 27. The key cylinder 90 is accommodated in the cylinder accommodation space 27.

As shown in FIG. 3A, a rotor shaft hole 28 having a keyhole-like shape is formed in the rotor attachment wall 25. The rotor shaft hole 28 supports rotatably the rotor 50. The rotor shaft hole 28 is positioned centrally in the short side direction of the housing 20, and is offset toward the cylinder accommodation space 27. A presser element moving hole 30 is formed in the rotor attachment wall 25 adjacent to the rotor shaft hole 28 so that the presser element 77 of the knob 70 is inserted swingably thereinto. A spring holding recess portion 31 and a spring supporting projection 31*a* which support one end of the knob biasing spring 80 are formed in a front surface of the rotor attachment wall 25. The spring holding recess portion 31 and the spring supporting projection 31*a* are provided opposite to the presser element moving hole 30 with respect to the rotor shaft hole 28.

As shown in FIG. 3B, a rotor accommodation recess portion 33 is formed in the bottom portion 21. The rotor accommodation recess portion 33 has a circular shape centered at the rotor shaft hole 28, and is provided on a rear of the rotor attachment wall 25. A cylindrical wall 34 is formed concentrically within the rotor accommodation recess portion 33 via a predetermined gap. An arc-shaped wall 35 project from a rear surface of the rotor attachment wall 25 inside the rotor accommodation recess portion 33, and a rotation restriction wall 36 is formed between the arc-shaped wall 35 and the cylindrical wall 34.

A key groove 37 is formed in the rear surface of the bottom portion 21 at a position corresponding to the cylinder accommodation space 27 (refer to FIG. 3B). Into the key groove 37, the projection 95 of the key cylinder 90 is inserted. This key groove 37 has a long groove-shaped open portion 38 and an arc groove-shaped lock portion 39. The open portion 38 extends along the long side direction of the housing 20, and the lock portion 39 extends from the end portion of the open portion 38 at a side of the rotor accommodation recess portion 33 along the short side direction of the housing 20. Pulling of the knob 70 is allowed when the projection 95 of the key cylinder 90 is inserted in the open portion 38, and pulling of the knob 70 is restricted when the projection 95 is inserted in the lock portion 39. Namely, the lock portion 39 is provided adjacent to the rotor 50 which is accommodated in the rotor accommodation recess portion 33. An engagement claw portion 40 projects from the bottom portion 21 at a circumferential edge of the side wall 24 so as to be engaged with a circumferential edge on a rear side of the installation hole 8 (refer to FIGS. 9, 10) in the lid 7. Guide projections 41, 41 project from the bottom portion 21 at positions corresponding to the cylinder accommodation space 27, that is, on circumferential edges of the side walls 22, 22, respectively. The guide projections 41, 41 constitute slide guides for the rods 60, 61.

An engagement claw 43 is formed substantially centrally on each side wall 22 in a longitudinal direction thereof, and this engagement claw 43 is deflectable via a U-shaped slit 43*a* and engages with the circumferential edge on the rear side of the installation hole 8. Plural projecting pieces 44, 44 are formed at both sides of the engagement claw 43 so as to engage with a circumferential edge of a front side of the installation hole 8. An arc-shaped projection 45 is formed on an edge portion of each side wall 22 opposite to the bottom portion 21. The arc-shaped projection extends from a position corresponding to the rotor shaft hole 28 towards a position corresponding to the cylinder accommodation space 27. This projection 45 functions to rotatably support the knob 70. Although the projection 45 of this embodiment has the arc shape, the projection 45 may be made up of plural pins.

As shown in FIG. 3A, a knob rotation restriction hole 46 having a long hole-like shape is formed on the side wall 24 at a height-wise center thereof. A damper installation hole 47 is formed in a corner portion between the side wall 24 and the side wall 22, and a damper 48 made up of an elastic member of rubber or the like is installed therein (refer to FIG. 1).

Figure 6A:
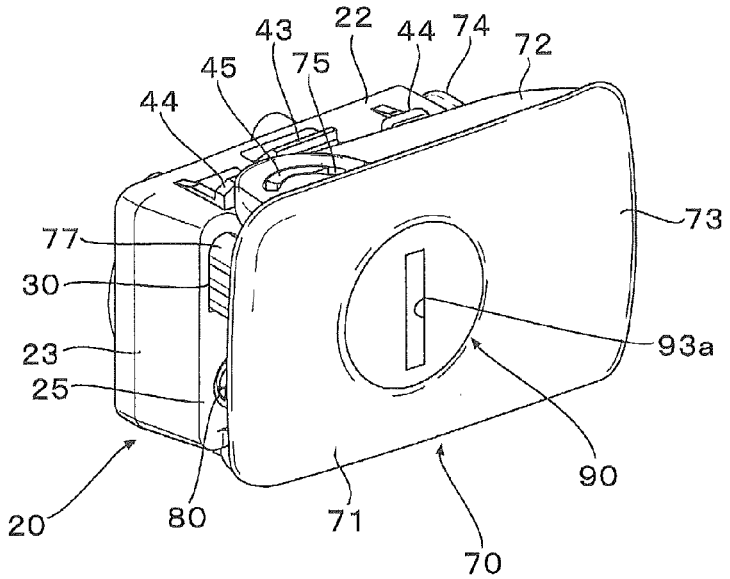
FIGS. 6A and 6B show the lock apparatus.
Figure 6B:
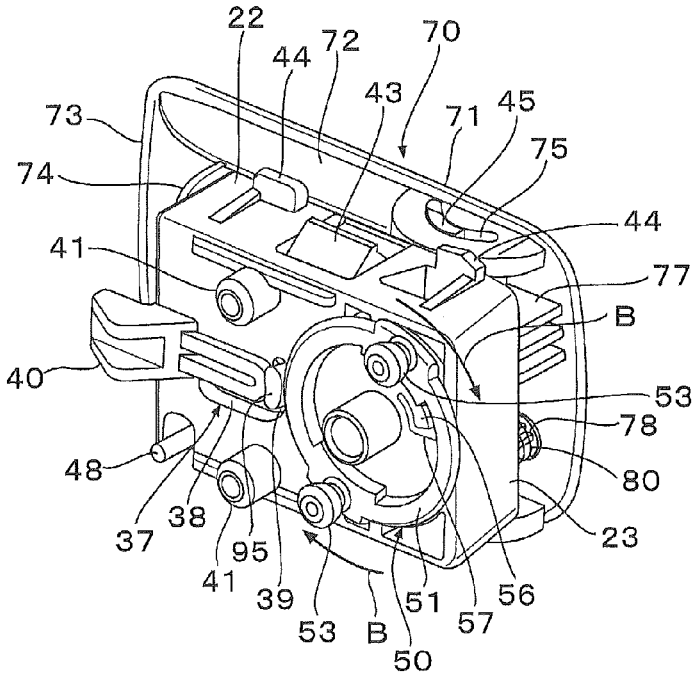

As shown in FIGS. 1, 2 and 4, the rotor 50 is attached rotatably to the housing 20. The rotor 50 includes mainly a main body 51, a rotational shaft 52, a pair of rod attachment portions 53, 53 and a cylindrical bearing portion 55. The circular main body 51 is accommodated in the rotor accommodation recess portion 33 of the housing 20. The rotational shaft 52 projects from a center of a front surface of the main body 51 so as to be inserted into the rotor shaft hole 28 to thereby be supported rotatably therein. The pair of rod attachment portions 53, 53 project from a rear surface of the main body 51 at point symmetric positions so as to support the rods 60, 61. The cylindrical bearing portion 55 projects from the front surface of the main body 51 so as to be pressed on by the presser element 77 of the knob 70. This rotor 50 is rotationally biased in a predetermined direction or in a direction indicated by an arrow B in FIG. 6B here by a return spring 58. There may be used a return spring adapted to bias at least one of the rods 60, 61 in a projecting direction.

Figure 4A:
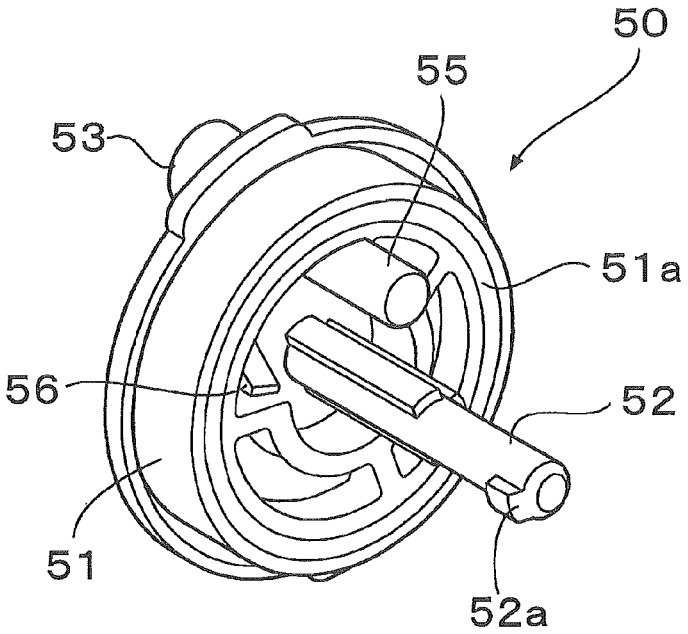
FIGS. 4A and 4B show a rotor which makes up the lock apparatus.
Figure 4B:
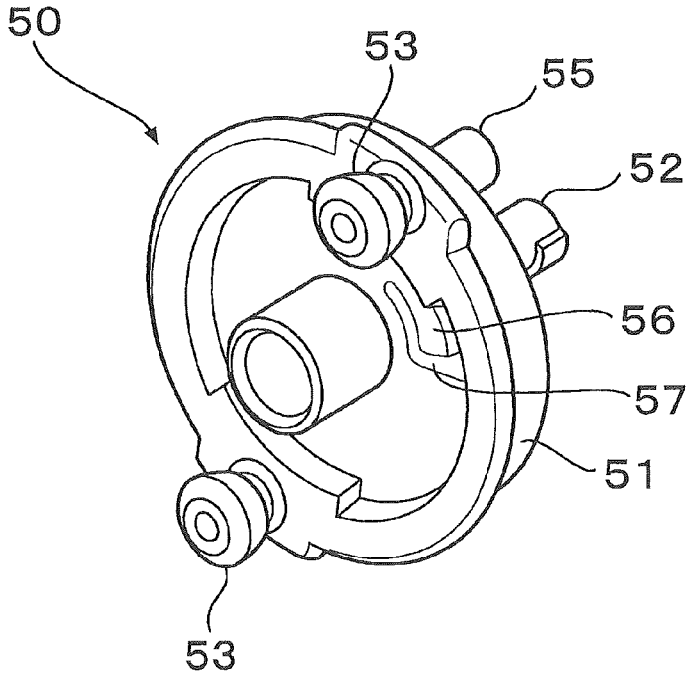

As shown in FIG. 4A, the main body 51 has a double wall construction in which two cylindrical walls are formed on an outer circumference of the main body 51, and an annular groove 51*a* is provided between them. A projecting portion 52*a* projects from a distal end portion of the rotational shaft 52, and this projecting portion 52*a* corresponds to the rotor shaft hole 28 having the keyhole-like shape. As shown in FIGS. 4A and 4B, a rotation restriction claw 56 is formed on the main body 51 near the projecting portion 52*a* of the rotational shaft 52 so as to deflect via a U-shaped slit 57.

As shown in FIGS. 1 and 2, attachment recesses 63 are provided in proximal end portions of the rods 60, 61, and the rod attachment portions 53, 53 of the rotor 50 are inserted into the attachment recesses 63, respectively, whereby the rods 60, 61 are attached to the rotor 50. Thus, distal end portions of the rods 60, 61 are pushed out of both side edge portions of the lid 7 by the return spring 58 so as to normally engage with engagement holes in the opening portion of the glove box via the rotor 50 which is rotationally biased in the direction indicated by the arrow B in FIG. 6B. Guide grooves 65 are formed in the rods 60, 61 along a longitudinal direction adjacent to the attachment recesses 63, respectively, so as to be supported slidably on the guide projections 41.

Figure 8:
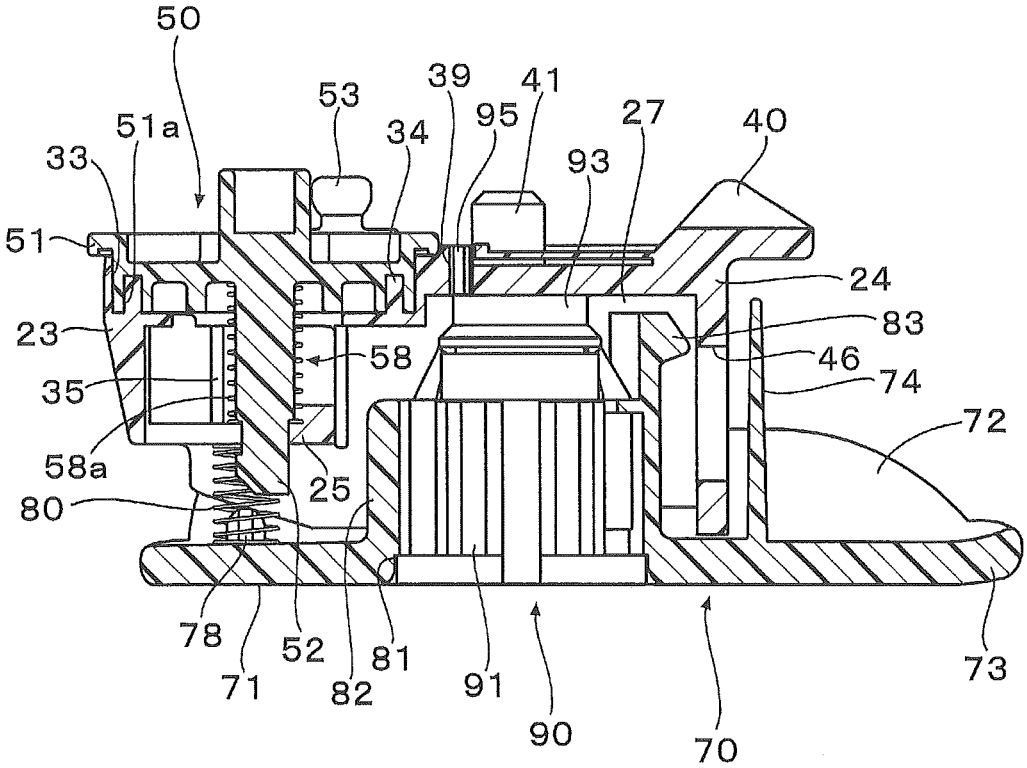
FIG. 8 is a sectional view of the lock apparatus.

Referring to FIGS. 1, 2, 5A and 5B, the knob 70 is attached rotatably to the housing 20. The knob has a front wall 71 and side walls 72. The horizontally long front wall 71 extends long in a horizontal direction so as to match the horizontally long rectangular parallelepiped box shape of the housing 20. The side walls 72 project from both longitudinal sides of the front wall 71. A longitudinal end of the front wall 71 of the knob 70 functions as a holding portion 73. A connecting wall 74 connects end sides of the side walls 72, 72 to each other. The connection wall 74 not only enhances the rigidity of the side walls 72, 72 but also covers the knob rotation restriction hole 46 in the housing 20 in such a state that the knob 70 is not rotated (refer to FIG. 8).

Arc-shaped grooves 75 are formed in the side walls 72, 72, respectively, at positions corresponding to the other longitudinal end of the front wall 71. The arc-shaped projections 45 on the housing 20 are inserted in these arc-shaped grooves 75, respectively, so that the knob 70 is attached rotatably to the housing 20. As shown in FIGS. 9 and 10, the knob 70 is made to rotate about centers of arcs of the arc-shaped grooves 75 as its rotating center C1 while being guided by the arc-shaped projections 45 which are inserted into the arc-shaped grooves 75.

The presser element 77 which presses on the bearing portion 55 of the rotor 50 and a spring supporting projecting portion 78 which holds the other end of the knob biasing spring 80 project from a rear surface of the front wall 71. The presser element 77 and the spring supporting projecting portion 78 are provided side by side and further closer to the other longitudinal end of the front wall 71 as compared with the arc-shaped grooves 75. As shown in FIGS. 9 and 10, the presser element 77 overlaps the bearing portion 55 of the rotor 50 with a predetermined overlap width L (which means a length over which the presser element 77 overlaps the bearing portion 55). By pulling the holding portion 73 of the knob 70 away from the housing 20 (refer to FIG. 10), the bearing portion 55 is pressed on so as to rotate the rotor 50 against the biasing force of the return spring 58, whereby the distal end portions of the rods 60, 61 are pulled out of the engagement holes in the opening portion of the glove box. A contact surface 77*a* of the presser element 77 for contacting the bearing portion 55 has a flat surface shape.

Figure 5A:
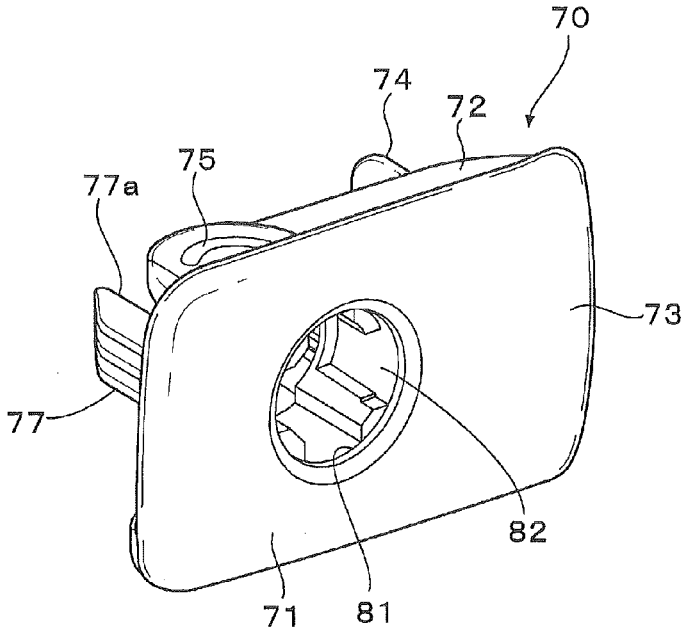
FIGS. 5A and 5B show a knob which makes up the lock apparatus.
Figure 5B:
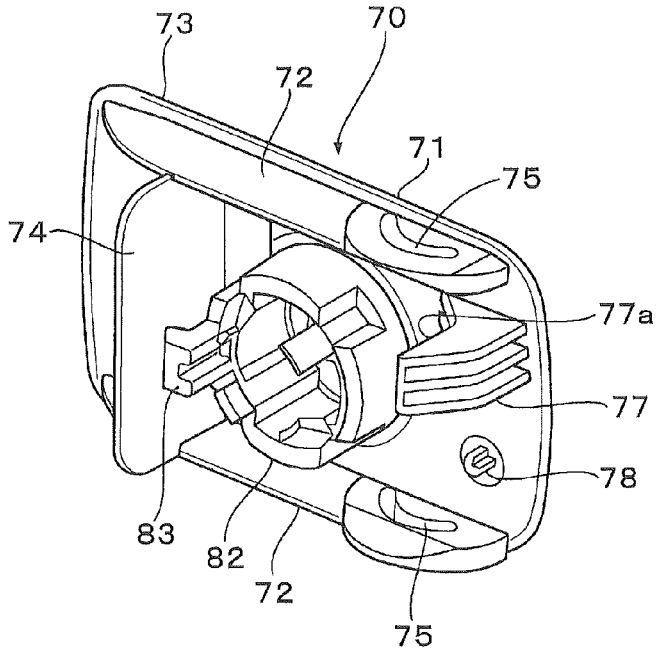

A key cylinder insertion hole 81 is formed in the front wall 71 of the knob 70 near the holding portion 73 than the rotating center C1. The key cylinder insertion hole 81 is aligned with the key groove 37 provided in the bottom portion 21 of the housing 20 when the knob 70 is attached to the housing 20. As shown in FIG. 5B, a key cylinder holding wall 82 projects from the rear surface of the front wall 71 at a circumferential edge of the key cylinder insertion hole 81. A stopper claw 83 projects from a distal end portion of the key cylinder holding wall 82 near the holding portion 73, and this stopper claw 83 engages with a hole edge of the knob rotation restriction hole 46 in the housing 20 to restrict the rotation of the knob 70 (refer to FIG. 10).

When the lock apparatus 10 is viewed from an axial direction of the rotating center C1 of the knob 70 as shown in FIG. 9 with the distal end portions of the rods 60, 61 kept engaged with the engagement holes in the glove box, the rotating center C1 of the knob 70 is positioned closer to the holding portion 73 than a contact point P between the bearing portion 55 of the rotor 50 and the presser element 77 of the knob 70.

Figure 11:
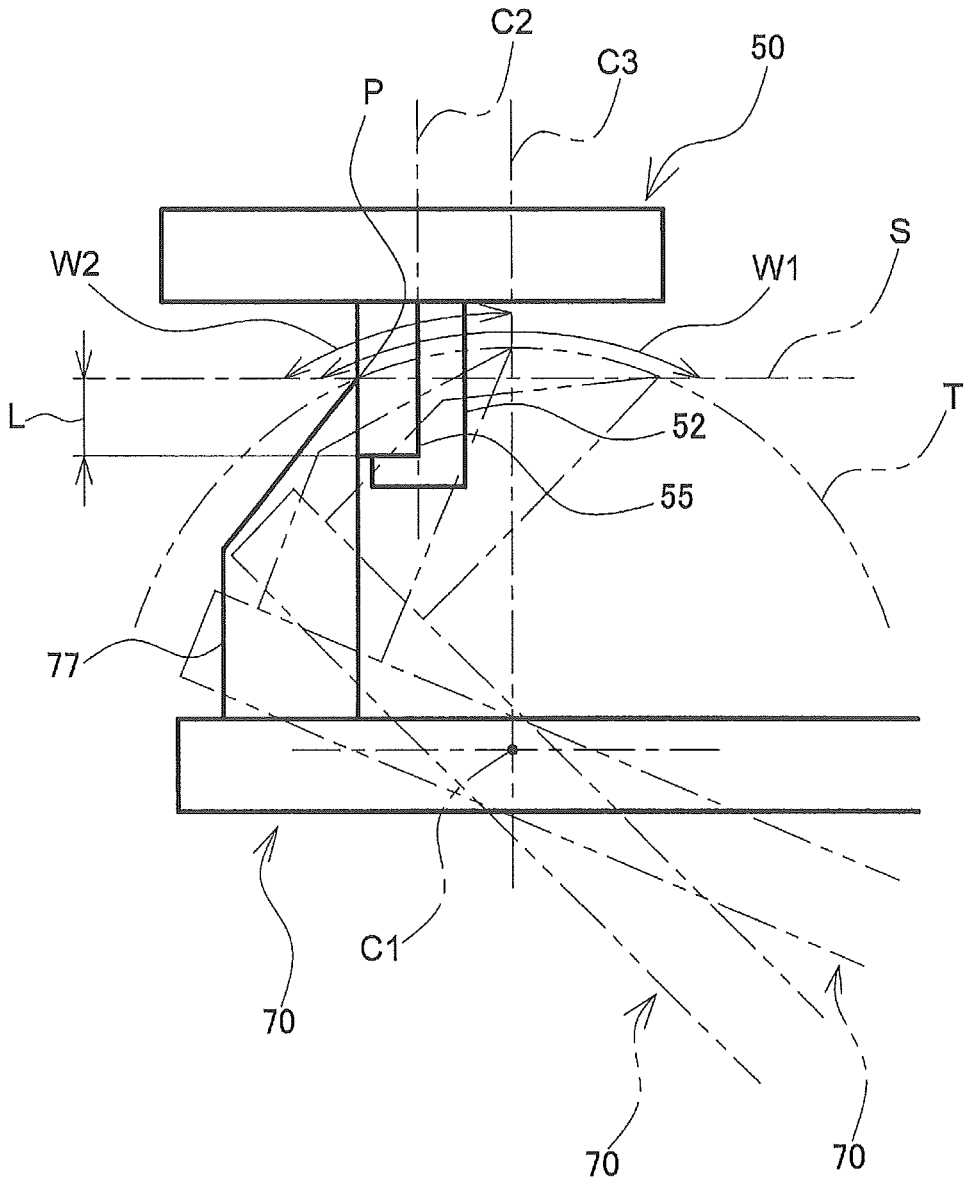
Figure 12:
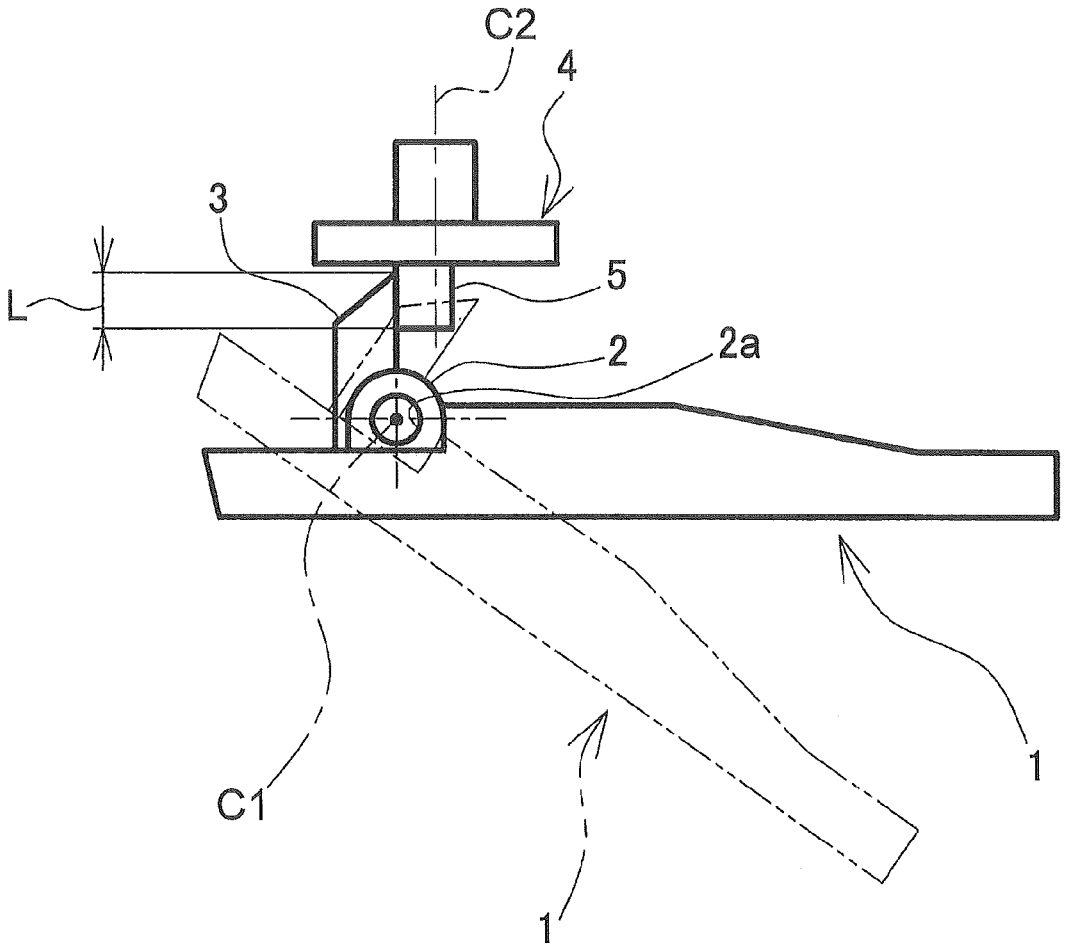
FIG. 12 is an explanatory diagram showing a conventional side lock apparatus.

Preferable settings of the overlap width L of the presser element 77 over the bearing portion 55 or the contact point P between the bearing portion 55 and the presser element 77 will be described by reference to FIG. 11 as follows. FIG. 11 shows a rotating locus T of the presser element 77 of the knob 70 which rotates about the rotating center C1. Reference character S denotes a line (overlap width line S) which intersects a rotating center C2 of the rotor 50 at right angles from a dimensional reference point of the overlap width L of the presser element 77 over the bearing portion 55 in an initial state where the distal end portions of the rods 60, 61 engage with the engagement holes in the opening portion of the glove box. In the rotating locus T, an inner circumferential side than portions where the overlap width line S intersects constitutes a range where the overlap width L is reduced more than the initial state where the distal end portions of the rods engage with the engagement holes, while an outer circumferential side constitutes a range where the overlap width L is increased more than the initial state.

It is preferable that when the distal end portions of the rods 60, 61 are pulled out of the engagement holes in the glove box by pulling the knob 70 with respect to the housing 20, the knob 70 stops rotating and the distal end portions of the rods 60, 61 are so pulled out within such a rotating range W1 that the overlap width L of the presser element 77 with respect to the bearing portion 55 does not become smaller than the overlap width L in the initial state where the rods 60, 61 engage with the engagement holes.

It is more preferable that when the distal end portions of the rods 60, 61 are pulled out of the engagement holes in the glove box by pulling the knob 70 with respect to the housing 20, the knob 70 stops rotating and the distal end portions of the rods 60, 61 are so pulled out within such a rotating range W2 that the contact point P between the bearing portion 55 and the presser element 77 does not go beyond a line C3 which passes through the rotating center C1 of the knob 70 and which is parallel to the rotating shaft (refer to the rotating center C2) of the rotor 50.

In this embodiment, when the knob 70 is pulled to rotate with respect to the housing 20, as shown in FIG. 10, the stopper claw 83 of the knob 70 engages with a hole edge of the knob rotation restriction hole 46 in the housing 20 so as to restrict the rotation of the knob 70. In this state, the knob 70 is made to stop rotating within such a rotating range that the contact point P between the bearing portion 55 and the presser element 77 lies slightly before the line C3 which passes through the rotating center C1 of the knob 70 and which is parallel to the rotational shaft (refer to the rotating center C2) of the rotor 50.

As shown in FIGS. 1 and 2, the key cylinder 90 is inserted into the key cylinder insertion hole 81 in the knob 70 while being held by the key cylinder holding wall 82. The key cylinder has a case 91, a rotary body 93 which is disposed rotatably in the case 91 and which has a keyhole 93*a* and the projection 95 which projects from a distal end portion of the rotary body 93. The projection 95 is offset from a rotating center of the rotary body 93, and is inserted rotatably in the key groove 37 in the housing 20. When the projection 95 is positioned in the open portion 38 of the key groove 37 (refer to FIG. 7A), the projection 95 slides within the open portion 38 as the knob 70 rotates, whereby the knob 70 is allowed to rotate. On the other hand, when the projection 95 is positioned in the lock portion 39 (refer to FIG. 8), the projection 95 engages with the lock portion 39 to thereby prevent the knob 70 being pulled, whereby the knob 70 is locked so as not to rotate.

A relationship between the components will be described. As shown in FIG. 9, the rotating center C1 of the knob 70 intersects the rotating center C2 of the rotor 50 at right angles and is positioned closer to the holding portion 73 of the knob 70 than the rotating center C2 of the rotor 50.

The presser element 77 of the knob 70 is positioned a predetermined distance away from the rotating center C1 opposite to the holding portion 73, and projects toward the rotor side 50. In this embodiment, in the initial state where the knob 70 does not rotate and the distal end portions of the rods 60, 61 engage with the engagement holes (refer to FIG. 9), the presser element 77 extends substantially parallel to the rotating center C2 of the rotor 50.

On the other hand, as shown in FIG. 9, a rotating center C4 of the key cylinder 90 is substantially parallel to the rotating center C2 of the rotor 50 and is disposed a predetermined distance away from the rotating center C1 of the knob 70 and closer to the holding portion 73 in the initial state where the knob 70 does not rotate and the distal end portions of the rods engage with the engagement holes.

Next, the working effect of the opening/closing member lock apparatus 10 which is configured as described above will be described.

The lock apparatus 10 is built up as will be described below. Namely, the end of the knob biasing spring 80 is held on the spring supporting projection 31*a* in the spring holding recess portion 31, while the other end thereof is held on the spring supporting projecting portion 78 of the knob 70. In this state, the arc-shaped projections 45, 45 on the housing 20 are inserted into the corresponding arc-shaped grooves 75, 75 in the knob 70. Thus, the knob 70 is attached rotatably to the housing 20 while being biased away from the housing 20 by the knob biasing spring 80 interposed between the housing 20 and the knob 70 in a compressed state.

Then, a coil portion 58*a* of the return spring 58 is disposed on the rotating shaft 52 of the rotor 50, and one of leg portions 58*b* of the return spring 58 is locked on the arc-shaped wall 35 of the housing 20, while the other leg portion 58*b* is locked on the main body 51 of the rotor 50. In this state, the rotor 50 is pushed after the projecting portion 52*a* of the rotating shaft 52 of the rotor 50 is aligned with the keyhole-shaped rotor shaft hole 28 in the housing 20. In this state, by rotating the rotor 50 against the biasing force of the return spring 58 in a direction indicated by an arrow A in FIG. 3B, the rotation restriction claw 56 rides over the rotation restriction wall 36 on the housing 20, whereby not only is the rotating shaft 52 supported rotatably in the rotor shaft hole 28, but also the main body 51 of the rotor 50 is accommodated in the rotor accommodation recess portion 33. Then, the cylindrical wall 34 on the housing 20 is inserted into the annular groove 51*a* (refer to FIG. 8), whereby the rotor 50 is attached rotatably to the housing 20 while being prevented from being dislocated therefrom. In this way, the knob 70 and the rotor 50 are assembled to the housing 20. In this state, the rotor 50 is rotationally biased in the direction indicated by the arrow B in FIG. 6B by the biasing force of the return spring 58. Even though the rotor 50 is attempted to be rotated further in the direction indicated by the arrow B, the rotation restriction claw 56 of the rotor 50 comes into abutment with the rotation restriction wall 36 of the housing 20 to thereby restrict the further rotation of the rotor 50.

Then, the housing 20 to which the knob 70 and the rotor 50 are assembled is inserted into the installation hole 8 (refer to FIG. 9) in the lid 7 from the rear side thereof. After the engagement claw portion 40 is inserted through the installation hole 8 and is then pulled backwards to engage with a circumferential edge on a rear side of the installation hole 8, the housing 20 is pushed in so that the engagement claw portion 40 and the engagement claws 43, 43 engage with the circumferential edge on the rear side of the installation hole 8 and the plural projecting pieces 44 engage with the circumferential edge on the front side of the installation hole 8, respectively, whereby as shown in FIG. 9, the housing 20 to which the knob 70 and the rotor 50 are assembled can be installed in the installation hole 8 in the lid 7. Thereafter, the attachment portions 53, 53 of the rotor 50 are inserted into the attachment recesses 63 of the rods 60, 61, respectively, whereby the pair of rods 60, 61 are disposed in the point symmetric manner with each other with respect to the rotating center C2 (refer to FIG. 11) of the rotor 50. The distal end portions of the rods 60, 61 are pushed out from both the side edge portions of the lid 7 towards the engagement holes in the opening portion in the glove box by the rotor 50 which is rotationally biased by the return spring to be engaged therewith.

When the lid 7 is pushed in to close the non-shown opening portion in the glove box, tapered rear surfaces of the non-shown distal end portions of the rods 60, 61 are pressed on by a circumferential edge of the opening portion in the glove box to slide inwards against the biasing force of the return spring 58. When the distal end portions of the rods 60, 61 reach the non-shown engagement holes in the opening portion, the rotor 50 is rotationally biased again by the return spring 58, whereby the distal end portions of the rods 60, 61 engage with the non-shown engagement holes, respectively, thereby locking the lid 7 into the locked state where the non-shown opening portion in the glove box is covered by the lid 7.

This state is shown in FIG. 9. Here, a non-shown key is inserted into the keyhole 93*a* of the key cylinder 90, the rotary body 93 is rotated relative to the case 91, and the projection 95 is inserted into the lock portion 39 of the key groove 37 in the housing 20 to be engaged therewith, whereby the knob 70 can be locked so as not to rotate relative to the housing 20 (refer to FIGS. 6B and 8).

As this occurs, since the lock portion 39 is provided in the bottom portion 21 of the housing 20 adjacent to the rotor 50, the lock portion 39 can be positioned near the rotating center C1 of the knob 70, and this reduces a traveling distance of the abutment portion between the projection 95 of the key cylinder 90 and the lock portion 39 which is triggered by a change in a rotational angle of the knob 70. Therefore, even though the projection 95 is relatively short, the projection 95 engages with the lock portion 39 in an ensured fashion, as a result of which the length of the projection 95 is shortened and the thickness of the housing 20 is thinned, whereby the lock apparatus 10 can be made compact in size.

Figure 7A:
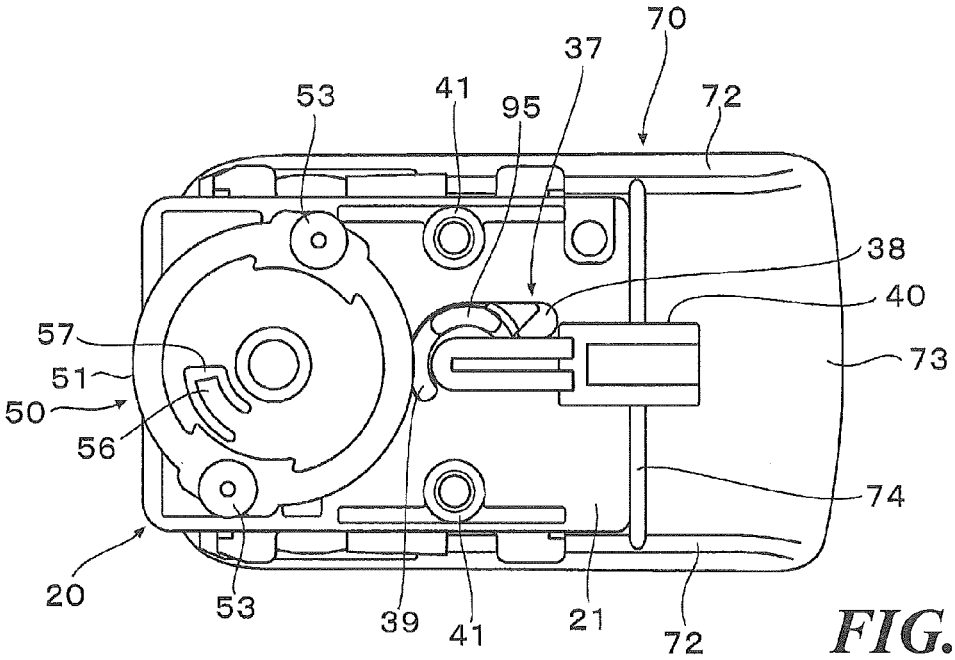
FIGS. 7A and 7B show the lock apparatus.
Figure 7B:
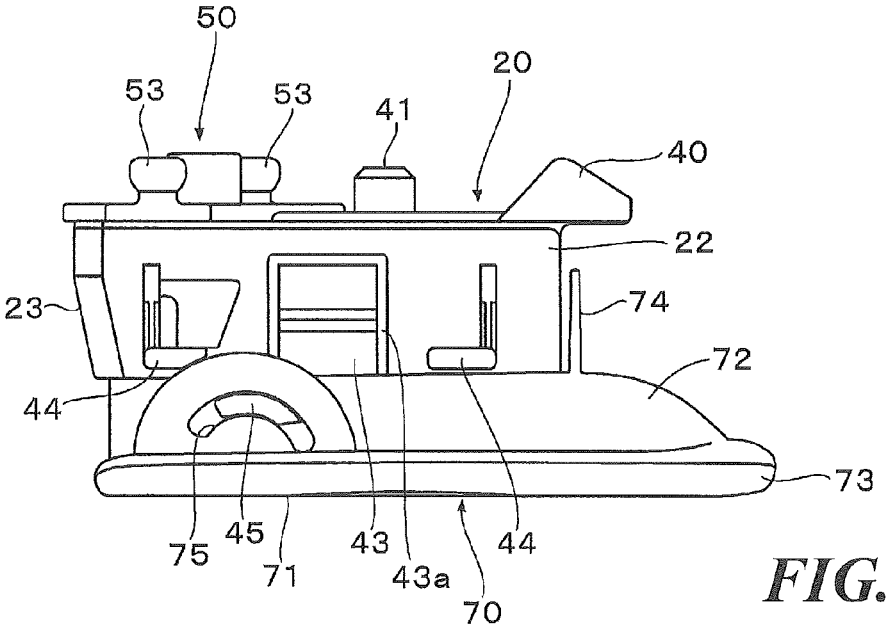

On the other hand, when the knob 70 is released from the locked state where the knob 70 is locked so as not to rotate relative to the housing 20, the key is inserted into the keyhole 93*a* to rotate the rotary body 93, so that the projection 95 is positioned in the open portion 38 of the key groove 37, whereby the knob 70 can be rotated (refer to FIG. 7A). When the holding portion 73 is pulled away from the housing 20, the bearing portion 55 of the rotor 50 is pressed on by the presser element 77 of the knob 70 to thereby rotate the rotor 50 against the biasing force of the return spring 58. When the distal end portions of the rods 60, 61 are pulled out of the engagement holes in the glove box, the lid 7 can be opened from the non-shown opening portion in the glove box.

According to this lock apparatus 10, in such a state that the distal end portions of the rods 60, 61 engage with the engagement holes in the glove box, the rotating center C1 of the knob 70 is positioned closer to the holding portion 73 than the contact point P between the bearing portion 55 and the presser element 77, as shown in FIG. 9. Therefore, as shown in FIG. 10, the overlap width L of the presser element 77 of the knob 70 over the bearing portion 55 of the rotor 50 can be increased gradually as the knob 70 is pulled. As a result, the overlap width L of the presser element 77 over the bearing portion 55 of the rotor 50 can be ensured, and therefore, not only can the rotor 50 be rotated in an ensured fashion by preventing the dislocation of the presser element 77 from the bearing portion 55, but also the presser element 77 and the bearing portion 55 do not have to be formed long, whereby the knob 70 and the rotor 50 can be formed as thin as possible, thereby making the lock apparatus 10 thin and compact in size.

Upon pulling of the knob 70, the knob 70 may stop rotating and the distal end portions of the rods 60, 61 may have been fully pulled out of the engagement holes in the opening portion in the glove box within such a rotating range W1 that the overlap width L of the presser element 77 with respect to the bearing portion 55 does not become smaller than the overlap width L in the initial state where the rods 60, 61 engage with the engagement holes (refer to FIG. 11). If they are set as described above, upon pulling of the knob 70, the distal end portions of the rods 60, 61 can be pulled out of the engagement holes without reducing the overlap width L of the presser element 77 with respect to the bearing portion 55 to be smaller than the overlap width L in the initial state. As a result, the dislocation of the presser element 77 from the bearing portion 55 can be prevented in a more ensured fashion.

Upon pulling of the knob 70, the knob 70 may stop rotating and the distal end portions of the rods 60, 61 may have been fully pulled out of the engagement holes in the opening portion in the glove box within such a rotating range W2 that the overlap width L of the presser element 77 with respect to the bearing portion 55 does not become smaller than the overlap width L in the initial state where the rods 60, 61 engage with the engagement holes (refer to FIG. 11). If they are set as described above, upon pulling of the knob 70, the distal end portions of the rods 60, 61 can be pulled out of the engagement holes while increasing the overlap width L of the presser element 77 with respect to the bearing portion 55 to be larger than the overlap width L in the initial state. As a result, the dislocation of the presser element 77 from the bearing portion 55 can be prevented in a much more ensured fashion.

In this embodiment, the arc-shaped grooves 75 are formed in the knob 70, and the knob 70 rotates about the centers of the arcs of the arc-shaped grooves 75 as the rotating center C1 (refer to FIGS. 9 and 10). This enables the rotating center to be provided close to the front surface of the knob 70, thereby making the whole of the lock apparatus 10 thinner.

In the above-described embodiment, while the lock apparatus 10 is attached to the lid 7 which is the opening/closing member, the lock apparatus 10 can also be attached to the glove box or the like which is the installation base member, and hence, there is imposed no specific limitation on where to attach the lock apparatus 10. The lock apparatus of the embodiment is applied to the construction in which the lid 7 is installed in the opening portion in the glove box so as to be opened and closed. On the other hand, the lock apparatus may also be applied to, for example, a construction in which a box-shaped glove box is installed in an opening portion in an instrument panel so as to be opened and closed, or a construction in which a lid is installed in an opening portion in an instrument panel so as to be opened and closed or the like (in which case the instrument panel constitutes the "installation base member" of the invention and the glove box and the lid constitute the "opening/closing member" of the invention). Thus, the lock apparatus of the embodiment can be used in various installation base members having an opening portion. In the embodiment, while the "engagement portion" to be engaged by the rod is described as being the engagement hole provided in the opening portion in the glove box, the engagement portion may be, for example, a circumferential edge portion of the opening portion or the like, and hence, any portion to be engaged by the rod may be used as the engagement portion.

DESCRIPTION OF REFERENCE NUMERALS

10 opening/closing member lock apparatus (lock apparatus); 20 housing; 39 lock portion; 50 rotor; 55 bearing portion; 58 return spring; 60, 61 rod; 70 knob; 73 holding portion; 75 arc-shaped groove; 77 presser element; 80 knob biasing spring; 90 key cylinder; 95 projection

The invention claimed is:

1. A lock apparatus for an opening/closing member which is installed in an opening portion in an installation base member so as to be opened and closed, including:

a housing which is attached to one of the installation base member and the opening/closing member;

a rotor which is attached rotatably to the housing;

a rod which is attached to the rotor so as to slide in an interlocked fashion with each other upon rotation of the rotor and so as to be engaged with or disengaged from an engagement portion provided on the other one of the installation base member and the opening/closing member;

a bearing portion which is provided on the rotor;

a return spring which rotationally biases the rotor directly or via the rod so that the rod is engaged with the engagement portion; and a knob which is attached rotatably to the housing and includes:

a front wall having a front surface and a rear surface;

a pair of side walls which project from both sides of the rear surface of the front wall;

a holding portion provided at one end of the front wall in a longitudinal direction; and a presser element projecting from the rear surface of the front wall at the other end of the front wall in the longitudinal direction so as to overlap the bearing portion with a predetermined overlap width, the presser element pressing on the bearing portion and rotating the rotor against a biasing force of the return spring to thereby pull the rod out of the engagement portion upon pulling of the holding portion of the knob, wherein, with the rod kept engaged with the engagement portion, a rotating center of the knob is positioned closer to the holding portion of the knob than a contact point between the bearing portion and the presser element, wherein an arc-shaped groove is formed in each of the pair of side walls so as to define an arc shape, whereas an arc-shaped projection or plural pin-shaped projections are formed on each of both sides of the housing and inserted into the arc-shaped groove, the arc-shaped projection or plural projections being movable within the corresponding arc-shaped groove along the arc shape, a center of the arc shape functioning as the rotating center of the knob, and wherein the center of the arc shape is provided close to the front surface of the front wall so that at least a part of the front surface of the front wall is encompassed within an imaginary circle drawn by extending the arc shape.

2. The lock apparatus of claim 1, wherein, upon pulling of the knob, the knob stops rotating and the rod is pulled out of the engagement portion within such a rotating range that the overlap width of the presser element with respect to the bearing portion does not become smaller than an overlap width in an initial state where the rod engages with the engagement portion.

3. The lock apparatus of claim 2, wherein, upon pulling of the knob, the knob stops rotating and the rod is pulled out of the engagement portion within such a rotating range that the contact point between the bearing portion and the presser element does not go beyond a line which passes through the rotating center of the knob and which is parallel to a rotational shaft of the rotor.

4. The lock apparatus of claim 1, wherein a key cylinder is mounted rotatably in the knob, wherein a projection projects from a distal end of the key cylinder while being offset from a rotating center of the key cylinder, wherein, when the key cylinder is in a predetermined rotational position, the projection engages with a lock portion of the housing so as to restrict pulling of the knob, and wherein the lock portion of the housing is disposed adjacent to the rotor.

5. The lock apparatus of claim 1, wherein, when viewed in a direction of the center of the arc shape, the center of the arc shape is positioned between the front surface and the rear surface of the front wall.

6. The lock apparatus of claim 1, wherein the imaginary circle passes through a widthwise center of the arc-shaped groove.

7. The lock apparatus of claim 1, wherein a distance between the presser element and a distal edge of the knob in a longitudinal direction is less than a distance between the presser element and the arc-shaped groove.

8. The lock apparatus of claim 1, further comprising a knob-biasing spring which is interposed between the knob and the housing so as to bias the knob to move away from the housing, wherein the housing includes:

a spring holding recess portion and a spring supporting projection which support one end of the knob biasing spring and are formed in a front surface of a rotor attachment wall; and a rotor shaft hole which rotatably supports the rotor, and wherein the spring holding recess portion and the spring supporting projection are provided opposite to the presser element with respect to a rotor shaft hole of the housing.

9. The lock apparatus of claim 1, wherein the housing has a rectangular box shape including:

a bottom portion;

a first pair of side walls which are erected from long sides of the bottom portion; and a second pair of side walls which are erected from short sides of the bottom portion, wherein the arc-shaped projection or plural pin-shaped projections are formed on an edge portion of each side wall of the first pair of side walls.

10. The lock apparatus of claim 1, wherein the rotor includes a rotational shaft which projects from a center of the rotor so as to be inserted into a rotor shaft hole of the housing, and wherein a projecting portion projects from a distal end portion of the rotational shaft.

11. The lock apparatus of claim 1, further comprising a knob-biasing spring which is interposed between the knob and the housing so as to bias the knob to move away from the housing.

12. The lock apparatus of claim 1, wherein a center of the arc-shaped groove is located away from the arc-shaped groove.

13. The lock apparatus of claim 1, wherein an inner radius of the arc-shaped groove is less than an outer radius of the arc-shaped groove.

14. The lock apparatus of claim 1, wherein the arc-shaped groove is non-symmetrical about a line which passes through a rotating center of the knob.

15. The lock apparatus of claim 4, wherein a rotating center of the key cylinder is substantially parallel to a rotating center of the rotor and is disposed at a predetermined distance away from the rotating center of the knob.

* * * * *